United States Patent [19]

Dykema

[11] Patent Number: 4,807,542

[45] Date of Patent: Feb. 28, 1989

[54] COAL ADDITIVES

[75] Inventor: Owen W. Dykema, Canoga Park, Calif.

[73] Assignee: Transalta Resources Corporation, Calgary, Canada

[21] Appl. No.: 123,044

[22] Filed: Nov. 18, 1987

[51] Int. Cl.[4] ..... F23B 7/00

[52] U.S. Cl. ..... 110/343; 44/622; 110/344; 110/345

[58] Field of Search ..... 110/343, 344, 345, 347, 110/342, 341; 431/4; 44/1 SR

[56] References Cited

U.S. PATENT DOCUMENTS

| | | | |
|---|---|---|---|
| 2,800,172 | 7/1957 | Romer et al. . | |
| 4,381,718 | 5/1983 | Carver et al. | 110/347 |
| 4,395,975 | 8/1983 | Ashworth et al. . | |
| 4,407,206 | 10/1983 | Bartok et al. | 110/347 |
| 4,423,702 | 1/1984 | Ashworth et al. . | |
| 4,428,310 | 1/1984 | Kekish et al. . | |
| 4,523,532 | 6/1985 | Moriarty et al. . | |
| 4,542,704 | 9/1985 | Brown et al. . | |
| 4,555,392 | 11/1985 | Steinberg . | |
| 4,577,566 | 3/1986 | Merrell . | |
| 4,582,005 | 4/1986 | Brown | 110/345 X |
| 4,602,918 | 7/1986 | Steinberg et al. . | |

*Primary Examiner*—Edward G. Favors

*Attorney, Agent, or Firm*—Mason, Fenwick & Lawrence

[57] ABSTRACT

A process for combusting a sulphur-bearing fuel is disclosed. A mixture of the fuel, a sulphur binding material and a sulphur retaining material is introduced into a first combustion zone. The mixture is combusted in the first zone under conditions of fuel-rich stoichiometry and temperature wherein substantially all of the sulphur is captured in a solid form by the sulphur binding material. The resulting captured sulphur compounds are then physically and/or chemically bound within or with the retaining material. Combustion products are thereby produced which include fuel-rich gases and solid flyash and slag containing mixtures of the captured sulphur and the binding and retaining materials. These combustion products are then further combusted in at least one additional fuel-rich combustion zone at temperatures above the fusion temperature of the solids, to melt the solids and to form complex, refractory mixtures and compounds containing the captured sulphur. Sodium and chlorine present in the fuel may also advantageously be captured and retained by the above process.

14 Claims, 3 Drawing Sheets

COAL ADDITIVES

BACKGROUND OF THE INVENTION

This invention relates to the combustion of sulphur-bearing fuels and more particularly to the capture and retention in solid form of sulphur and optionally sodium and chlorine or other undesirable compounds during the combustion of these fuels.

Sulphur is desirably captured and retained in a solid form during combustion to lower the amount of air pollution created by the combustion. It is desirable to capture and retain sodium and chlorine because these normally vaporize or gasify during combustion and subsequently condense on boiler heat transfer surfaces, causing slagging and fouling. Many otherwise attractive high sodium content and/or high chlorine coals are little used and are of low cost for this reason.

U.S. Pat. No. 4,523,532 issued June 18, 1985 (Moriarty et al) and U.S. Pat. No. 4,517,165 issued May 14, 1985 (Moriarty), the contents of both of which are incorporated herein by reference, disclose processes for combusting sulphur-bearing fuels. The processes disclosed in these patents have been extensively tested in two experimental combustion devices called low $NO_x/SO_x$ burners. These were fired primarily with coal fuels but with a high sulphur residual oil as well. In these processes, the fuel is first combusted in a first stage, in the presence of solid sulphur binding and retaining compounds, under reducing conditions and at temperatures at which conventional thermodynamics predicts sulphur will be captured in a solid form by the binding material. The fuel is then further combusted in a subsequent stage under somewhat less reducing conditions and at temperatures higher than the fusion temperature of the binding and retaining materials. The combustion conditions in this subsequent stage are such that conventional thermodynamics predicts complete loss of the captured sulphur (i.e., oxidation to gaseous sulphur forms).

Capture of fuel-sulphur in the solid form during combustion through the use of solid binding materials is well known in the art. For example, U.S. Pat. No. 4,555,392 issued Nov. 26, 1985 (Steinberg) discloses the use of Portland cement as a sulphur-capturing material. Also, combustion conditions and binding materials for optimum sulfur capture are disclosed in the Moriarty patents, incorporated herein. However, the retention of the sulphur in a solid form through subsequent stages is not generally addressed in the prior art.

SUMMARY OF THE INVENTION

It is desirable to have a combustion process wherein sulphur and optionally other undesirable compounds are captured and retained in solid forms during the combustion process.

Accordingly, in one of its aspects, the invention provides a process for combusting a sulphur-bearing fuel. A mixture of the fuel, a sulphur binding material and a sulphur retaining material is introduced in a first combustion zone. The mixture is combusted in the first zone under conditions of fuel-rich stoichiometry and temperature wherein substantially all of the sulphur is captured in a solid form by the sulphur binding material. The sulphur is chemically bound to the binding material and in addition the resulting captured sulphur compounds are physically and/or chemically bound within or with the retaining materials. Combustion products are thereby produced which include fuel-rich gases and solid, sulphur-bearing flyash and slag.

These combustion products are then further combusted in at least one additional fuel-rich combustion zone at temperatures above the fusion temperatures of the solids, to melt the solids. Conditions in this additional combustion zone would normally thermodynamically favour oxidation of the captured sulphur to gaseous forms. Instead, due to the presence of the mixture of materials of the present invention, the captured sulphur and the binding and retaining materials interact further, in the molten state, to form complex mixtures of stable, refractory compounds. The sulphur is thus encapsulated within this molten, refractory mixture and is thereby protected from oxidation to gaseous sulphur species even in subsequent regions of high temperature oxidizing combustion. Other undesirable components of the fuel, such as sodium and chlorine, may also advantageously be captured and retained by the above process.

The reaction of the sulphur with the binding material provides the sulphur capture. The subsequent interactions of the so-captured sulphur with the retaining material provide improved retention of the sulphur so captured and, as a result, improved overall control of gaseous sulphur effluents. Some of the resulting solid products are refractory and are therefore resistant to further reaction even at high temperatures and under oxidizing conditions. Sulphur captured and retained in this manner is not oxidized to gaseous sulphur dioxide in the more oxidizing conditions of subsequent combustion.

Preferably, the sulphur binding material is calcium-based and the sulphur retaining material is silicon-based. The ratio of calcium to sulphur in the as-fired fuel is preferably at least 1.5, and the ratio of silicon to calcium involved in sulphur capture is 0.6 to 1.2 and preferably 0.8 to 1.0.

Applicant does not wish to be bound by any particular theory, but it is believed that the following explains why these molar ratios are advantageous. Calcium is used to capture sulphur because it forms compounds with sulphur that are stable at high temperatures. In addition, it also forms complex, refractory compounds with other common materials such as silicon and aluminum. Sufficient calcium must be available to capture the sulphur but the simple availability of the calcium does not assure that the sulphur will be captured. The fuel must first be combusted under an appropriate air/fuel ratio and temperature conditions to capture the sulphur. Given both the proper conditions of combustion and the availability of the calcium, the sulphur will be captured.

Conventional combustion thermodynamic equilibrium computer calculations normally do not take into account the formation even of such common refractory compounds of calcium, silicon and aluminum as anorthite and pseudowollestonite. While many of these compounds are well known, the necessary thermodyanmic data either are not available or simply have not yet been incorporated into the equilibrium calculations. In addition, sulphur is known to readily substitute for oxygen in many compounds, including the substitution in lime (CaO) to form calcium sulfide (CaS). Oxygen and sulphur are adjacent in the same column of the periodic table and so are chemically similar. Therefore, it is possible, although not yet substantiated, that under sufficiently high temperature, fuel-rich combustion conditions, sulphur may substitute for oxygen in some of these complex, refractory calcium-silicon-aluminum compounds.

Such sulphur-substituted refractory compounds do not normally occur. As a result, thermodynamic data on such compounds are not available, and are rarely included in equilibrium combustion calculations. In the absence of complete thermodynamic data, then, it is necessary to assume non-equilibrium retention of captured sulphur in the subsequent higher temperature, more oxidizing regions of combustion. However, one would expect that the resulting sulphur-bearing compounds would exhibit the stable, refractory characteristics of the original material.

Current thermodynamic equilibrium calculations generally indicate that under high temperature, very fuel-rich combustion conditions the thermodynamically preferred form of sulphur is solid calcium sulphide (CaS). This would suggest that if at least a 1:1 mole ratio of calcium to sulphur were available then all of the sulphur would be captured, in this solid form. Study of considerable data from coal combustion and from analyses of coal ash ("ignited basis"), however, indicates that sulphur is actually captured by calcium at the rate of one mole of sulphur for each two moles of calcium. Sulphur may also be captured by other basic elements such as magnesium, sodium and potassium.

In the absence of retaining material, sulphur captured by calcium is generally not retained through subequent stages of combustion. Sulphur captured by magnesium is generally not retained through subsequent stages of combustion even in the presence of retaining material. It appears that the solid calcium-sulphur compounds must interact and/or react with retaining material to assure that the captured sulphur is retained. The preferred retaining material is silicon with, in some cases, some aluminum. For optimum retention of captured sulphur the mole ratio of silicon to calcium involved in the sulphur capture is at least 0.8. For example, if the calcium/sulphur mole ratio is greater than two, then the silicon/sulphur mole ratio need only be 1.6 since only two moles of calcium will be involved in the sulphur capture.

It has been found that, at least in the data sample available, aluminum does not appear to be limiting on the sulphur retention. In most of the data studied the mole ratio of aluminum to calcium and to silicon was less than one-third. If aluminum was limiting, the sulphur retention would have been one-third of what was actually measured for these fuels.

A well-known refractory compound embodying a 1:1 calcium-silicon mole ratio and no alumina is pseudowollestonite ($CaO.SiO_2$). For the analog of such a compound to contain both calcium and silicon in 2:1 mole ratios to sulphur suggests that two moles of pseudowollestonite might be involved, with sulphur substituted for oxygen in one of the two lime molecules (CaO.CaS.-2SiO2). Pseudowollestonite has a melting point of 1540° C. (2800° F.). One would expect the sulphur-bearing analog to have similar refractory properties.

It is believed that other compounds such as sodium and chlorine may be captured and retained in solid forms in a manner similar to that for sulphur in the process of the present invention. For example, limited combustion equilibrium calculations have indicated the sodium may be retained in compound forms like $Na_2O.Al_2O_3$ and $Na_2O.2SiO_2$. Again, these equilibrium calculations indicate that sodium captured in this manner, under very fuel-rich combustion conditions, would be oxidized/vaporized under the higher oxygen and higher temperature conditions of subsequent stages of combustion if it were not bound in complex chemical forms such as these, and encapsulated in the molten solids.

Chlorine is believed to be captured in a manner similar to sulphur, as it is directly adjacent to and in the same row as sulphur in the periodic table. One might expect chlorine analogs for the sulphur-bearing compounds discussed herein.

DESCRIPTION OF THE PREFERRED EMBODIMENTS

The present invention is suitable for use with solid and liquid fuels. The required sulphur binding and retaining materials may be inherent in or may be added to the fuel. Preferably, the sulphur binding material is calcium-based and the sulphur retaining material is silicon-based. The low rank lignite and subituminous coals often contain a sufficient amount of both materials. Higher rank bituminous and anthracite coals usually contain very little calcium and insufficient silicon relative to the sulphur, and both must be added. Liquid fuels, of course, contain neither of these solid materials.

The preferred overall calcium to sulphur mole ratio is 1.5 or more and is most preferably between 1.5 and 2.5. The silicon to calcium mole ratio is advantageously 0.6 to 1.2 and preferably 0.8 to 1.0. In cases where calcium and silicon must be added these materials may be added in nearly any form, preferably in low cost forms like limestone and sand.

With some coals some of the sulphur may be preferentially captured by other basic materials, primarily magnesium. The resulting magnesium-sulphur compounds do not appear to form suitable complexes with the retaining material. Sulphur captured by magnesium is largely lost in subsequent stages of combustion.

In addition, preferential sulphur capture by these materials may prevent the desired capture of sulphur by calcium. Many subituminous and lignite coals contain half as much magnesium as calcium. In these cases as much as one-third of the fuel sulphur can be preferentially captured by the magnesium, leaving only two-thirds available for capture by calcium. Excess calcium does not appear to compensate for the presence of magnesium. Therefore, in such cases, the preferred amount of calcium in the coal need only be that sufficient to provide a 2:1 mole ratio to the sulphur remaining available for capture by calcium; i.e., that that sulphur not already captured by other basic materials such as magnesium. In other words, the mole ratio of basic components, such as magnesium and calcium, to sulphur is 2:1.

Combustion conditions for optimum sulphur capture and retention are disclosed in the Moriarty patents, incorporated herein. The presence of the sulphur binding materials and the sulphur retaining materials may advantageously result in a reduced fusion temperature of the solids. The combustion temperature in the second zone of the present invention therefore may be lower than the lower limit of the temperature range reported in these patents, i.e. it may be as low as 1600° K., provided it is above the fusion temperature of the solids.

Normally, at least one more combustion zone is used in conjunction with the two involved in the present invention. This final zone is required to complete fuel combustion, in excess air. This invention makes it possible for sulphur-bearing solids to pass through this final combustion zone without losing the captured sulphur.

Alternatively, the solids may be removed from the system prior to this zone.

The invention will also be further described, by way of illustration only, with reference to the following examples.

The examples will be described with reference to the following drawings in which.

EXAMPLE 1

Standard ASTM analyses of coal ash on an ignited basis include burning the coal in a muffle furnace, at relatively low temperatures. A sample of 24 such ash analyses, of coal as received from the mine, were taken from a coal data book. An additional five ASTM ash analyses were available from coal blends tested in a low NOx/SOx burner. Performance data from this low NOx/SOx burner are discussed in Examples 3, 4 and 5. Although combustion in the muffle furnace is at relatively low reported as $SO_3$. Under these conditions sulphur will be captured by both calcium and magnesium and temperatures are sufficiently low that all captured sulphur will be retained.

The data sample from the coal data book includes ash analyses from six Montana and North Dakota lignites, from four Colorado, Montana and Wyoming subituminous coals, and from 14 bituminous coals from 10 different states. Of the five coal blends eventually tested in the low NOx/SOx burner, one involved a Wyoming subituminous coal and the remainder involved bituminous coals from Indiana, Pennsylvania and Nova Scotia. Various combinations of calcium and silicon, as limestone and sand, and in one case some powdered alumina, were added to the test coals. Magnesium levels in some of the lower rank coals in the data sample were more than half those of the calcium. Silicon levels in some of the higher rank coals were less than half those of the calcium. In all cases the data of this example are from ASTM ash analyses of these coals and coal/additive blends and not from ashes resulting from combustion in the low NOx/SOx burner.

Figure 1:
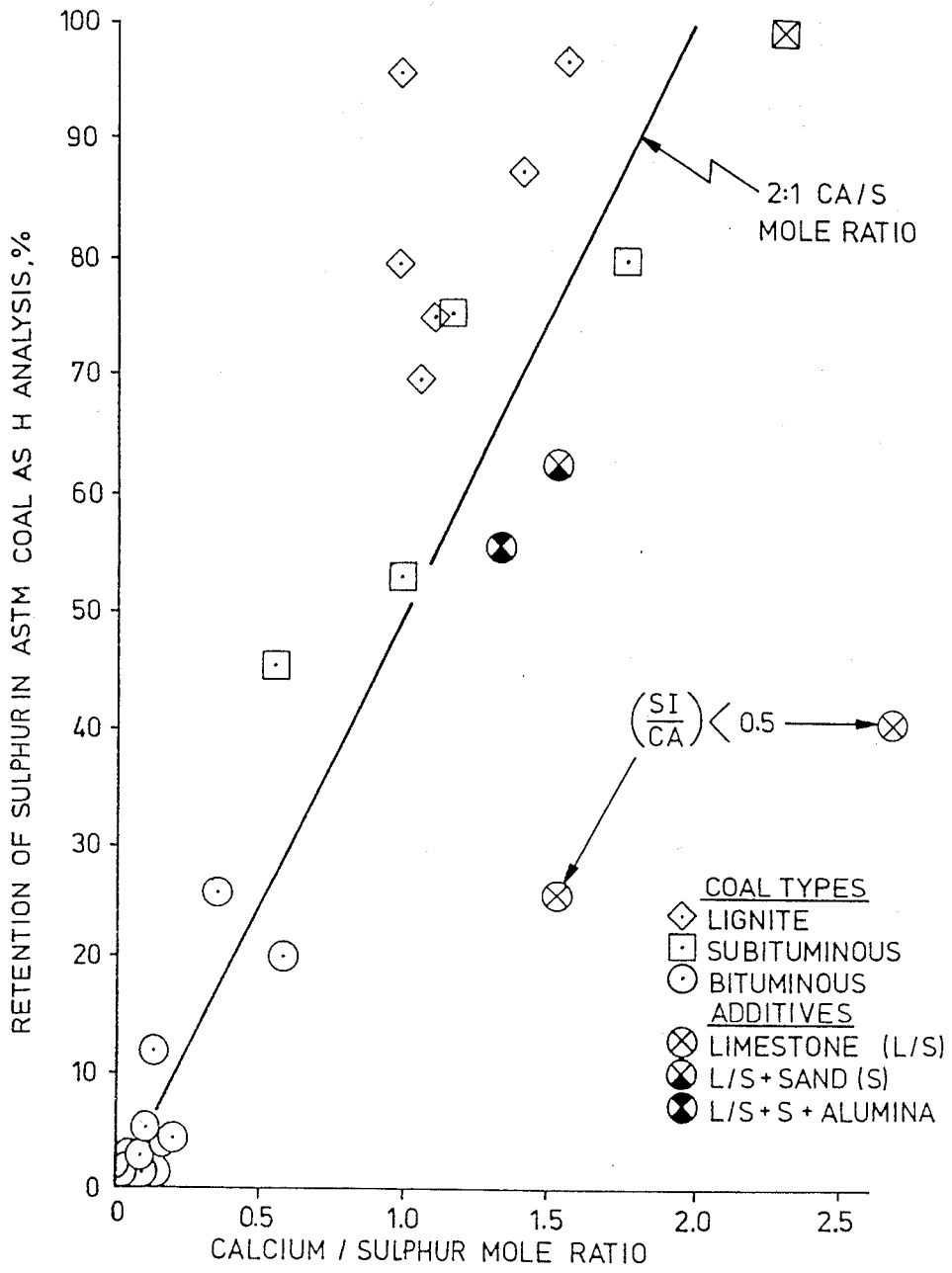
FIG. 1 is a plot of ASTM ashing data showing the correspondence between measured sulphur retention in coal ashes and the mole ratio of calcium to sulphur in the coal.

The mole ratio of silicon to calcium in all but two of the coal ashes in the data sample was greater than 0.8. The two exceptions are noted in FIG. 1. FIG. 1 shows capture and retention of sulphur in these ASTM coal ashes in good agreement with the 2:1 mole ratio of calcium to sulphur, for those coals in which the mole ratio of silicon to calcium was greater than 0.8. Limits of the data suggest controlling calcium/sulphur mole ratios ranging from 1.2 to 2.4 An empirical correlation of that data shows an average ratio of 1.93, with a correlation coefficient of 0.92 and a standard error of the estimate of 14.6%. This is a reasonably good correlation, and the 2:1 mole ratio is within the uncertainty of the correlation. Closer examination of the data shows that where the measured sulphur capture is higher than would be predicted from a 2:1 calcium/sulphur mole ratio (the lignites) it it is generally higher by about the amount that is captured by magnesium.

On the average, the mole ratio of silicon to calcium in the correlated lignite and subituminous coal data in FIG. 1 was 1.38, and was much higher in the as-received bituminous coals. Three lignite coals had silicon to calcium mole ratios averaging as low as 0.89. In the four bituminous coals tested using ASTM analyses, calcium (only) was added to the first two coals and both calcium and silicon (and some alumina) were added to the second two coals. As a result, the silicon to calcium ratio averaged only 0.42 in the first two but 0.87 in the second two. The sulphur retention in the coal ashes of the first two coals, labelled in FIG. 1 as "(SI/CA)<0.5." was considerably lower, by more than a factor of two, than that in the ashes from other coals, containing the same proportions of calcium to sulphur but higher proportions of silicon to calcium. On the other hand, when both calcium and silicon were added to these bituminous coals sulphur retention was comparable to that with subituminous and lignite coals. These four bituminous coal cases indicate that even at the low temperature conditions of a muffle furnace it is not enough just to provide calcium sufficient to capture the sulphur, there must also be adequate silicon to retain that captured sulphur.

EXAMPLE 2

A series of three tests were run on a low $NO_x/SO_x$ burner similar to the burner disclosed in the above-mentioned Moriarty and Dykema patent with a California high sulphur residual oil as the fuel. This oil contained 4.51 percent sulphur. In one test calcium, as lime, was added to the oil in sufficient quantity to provide a calcium-sulphur mole ratio of 1.88, sufficient to capture 94 percent of the sulphur in the oil, at the 2:1 calcium-sulphur mole ratio. Only the first and second stages of the burner were operational in these tests. Sulphur capture was measured in both stages. Under the best sulphur capture conditions an average of 89 percent of the sulphur was captured. With no silicon or retaining material of any kind in the mixture, however, it would be expected that all of this captured sulphur would be oxidized to $SO_2$ before going up the stack. This burner did not have a stack but 24 percent of the captured sulphur was lost in the second stage, leaving only 65 percent of the sulphur still controlled by the end of the second stage. Even greater loss of captured sulphur would be expected in subsequent stages of combustion.

A conclusion here is that material in addition to calcium is necessary to protect and retain the captured sulphur. It is anticipated that if an approximately equimolar mixture of calcium and silicon were added to that oil, in the preferred mole ratios to sulphur of about 2:1 of each, greatly improved retention of the captured sulphur would have been obtained.

EXAMPLE 3

The muffle furnace used in ASTM ashing and the low NOx/SOx burner represent somewhat similar combustion processes except that the final oxidizing stages in the low NOx/SOx burner are at much higher temperatures than occur in the muffle furnace. One would expect the composition of the flyash, and the degree of sulphur capture, in the early stages of the burner to be similar to that of the ASTM ash analysis for that coal. Later in the burner, however, any sulphur which was captured but was not securely retained would be oxidized to gaseous sulphur species. Differences between sulphur concentrations measured in flyash taken from the baghouse of the low NOx/SOx burner and those measured in the ASTM ash analyses of those same coals, then, represent sulphur that was captured initially but was not securely retained.

A total of seven coals and coal/additive blends were fired in a low NOx/SOx burner. Complete analyses of baghouse flyash were available from five of these. Table 1 shows the sulphur retained in the coal ash and in the baghouse of flyash in these tests. The difference between these represents the loss of captured sulphur in the higher temperature combustion of the low NOx/-SOx burner relative to the lower temperature combustion in the ASTM muffle furnace. In the last column of Table 1 is shown one-half of the magnesium/sulphur mole ratio, expressed in percent. This column effectively represents the percent of the sulphur captured by magnesium in the coal ash, at the 2:1 magnesium to sulphur mole ratio.

TABLE 1

| Test No. | Sulphur Captured, % Coal Ash | Flyash | Loss, Ash-Baghouse | Mg/2S, % |
|---|---|---|---|---|
| 31 | 99.4 | 56.3 | 43.1 | 26.8 |
| 32 | 40.7 | 55.1 | −14.4 | 2.8 |
| 33 | 25.7 | 38.4 | −12.7 | 2.8 |
| 34 | 62.6 | 64.7 | −2.1 | 2.7 |
| 35 | 55.7 | 57.3 | −1.6 | 2.7 |

The coal fired in test 31 was Caballo, a low sulphur western subituminous coal with mole ratios of calcium and magnesium to sulphur of 2.31 and 0.54, respectively. The coals fired in tests 32 through 35 were high sulphur eastern bituminous coals containing practically no magnesium. The data in Table 1 show that with the subituminous coal a large fraction of the sulphur that was captured and retained in the ASTM ashing process was lost enroute to the baghouse in the low $NO_x/SO_x$ burner. With the bituminous coals, however, the degree of sulphur capture and retention are very nearly the same in the burner as in the ASTM ash analyses. Not only is there no apparent loss in captured sulphur in the burner but some additional sulphur is apparently captured by these flyashes enroute to the baghouse. The major difference between the subituminous and the bituminous cases is the relative concentration of magnesium. This suggests that magnesium may capture sulphur, preferentially over calcium in the coal ash or in the initial flyash, but regardless of the availability of retaining material, will lose this captured sulphur in the subsequent stages of combustion. The presence of magnesium in a coal, then, can limit effective control of the effluents of gaseous sulphur.

EXAMPLE 4

A number of low sulphur western subituminous coals were tested in the low $NO_x/SO_x$ burner previously described. These coals are shown in Table 2, along with the as-fired proportions of the oxides and the mole ratios of calcium, silicon and aluminum. All of these coals except Kaiparowits were tested in the one ton per hour, pilot-scale low $NO_x/SO_x$ burner. Kaiparowits was tested in a 1500 lb/hr low $NO_x/SO_x$ burner. The proportions of the oxides of calcium, silicon and aluminum in the as-fired coal ash, expressed as percent of the total of these three components, are given in Table 2 and are shown in a ternary diagram in FIG. 2. The table also shows one-half the mole ratios of calcium to sulphur and mole ratios of silicon to calcium in the coal, also expressed in percent. Under the assumption that maximum possible capture and retention of sulphur is governed by about a 2:1 mole ratio of calcium to sulphur and about a 1:1 mole ratio of silicon to calcium, these mole ratio data then predict maximum sulphur capture and retention. All of these coals were tested under the fuel-rich, high temperature combustion conditions mentioned earlier.

TABLE 2

Low Sulphur Western Subituminous Coals (as-fired) (all data expressed in percent)

| Test No. | Coal | CaO | $SiO_2$ | $Al_2O_3$ | Ca/2S | Si/Ca |
|---|---|---|---|---|---|---|
| XX | Kaiparowits | 23 | 59 | 18 | 89 | 257 |
| 23 | Whitewood | 14 | 68 | 18 | 196 | 462 |
| 24 | Black Mesa | 11 | 65 | 25 | 101 | 561 |
| 30 | Spring Creek | 30 | 49 | 21 | 83 | 154 |
| 31 | Caballo | 34 | 48 | 19 | 117 | 129 |
| 36 | Whitewood | 41 | 45 | 14 | 830 | 103 |

In all of these coals the calcium/sulphur mole ratios are sufficiently large to allow capture of 83 percent or more of the sulphur, assuming about a 2:1 calcium/sulphur mole ratio is required. In the tests no more than about 70 percent of the sulphur was captured. The difference between allowable maximum and actual capture is considered to be interference from the magnesium in the coal.

In all of these coals the silicon/calcium mole ratio is sufficiently large to allow for retention of all captured sulphur. Regardless of how much sulphur might be captured by the calcium there is more than enough $SiO_2$ with which it can mix and/or combine, to form the refractory mixture that assures retention of the captured sulphur. In all testing of these coals sulphur captured by calcium in the first stage of combustion was retained, with no measurable losses, through all subsequent stages of combustion, and into the baghouse.

Figure 2:
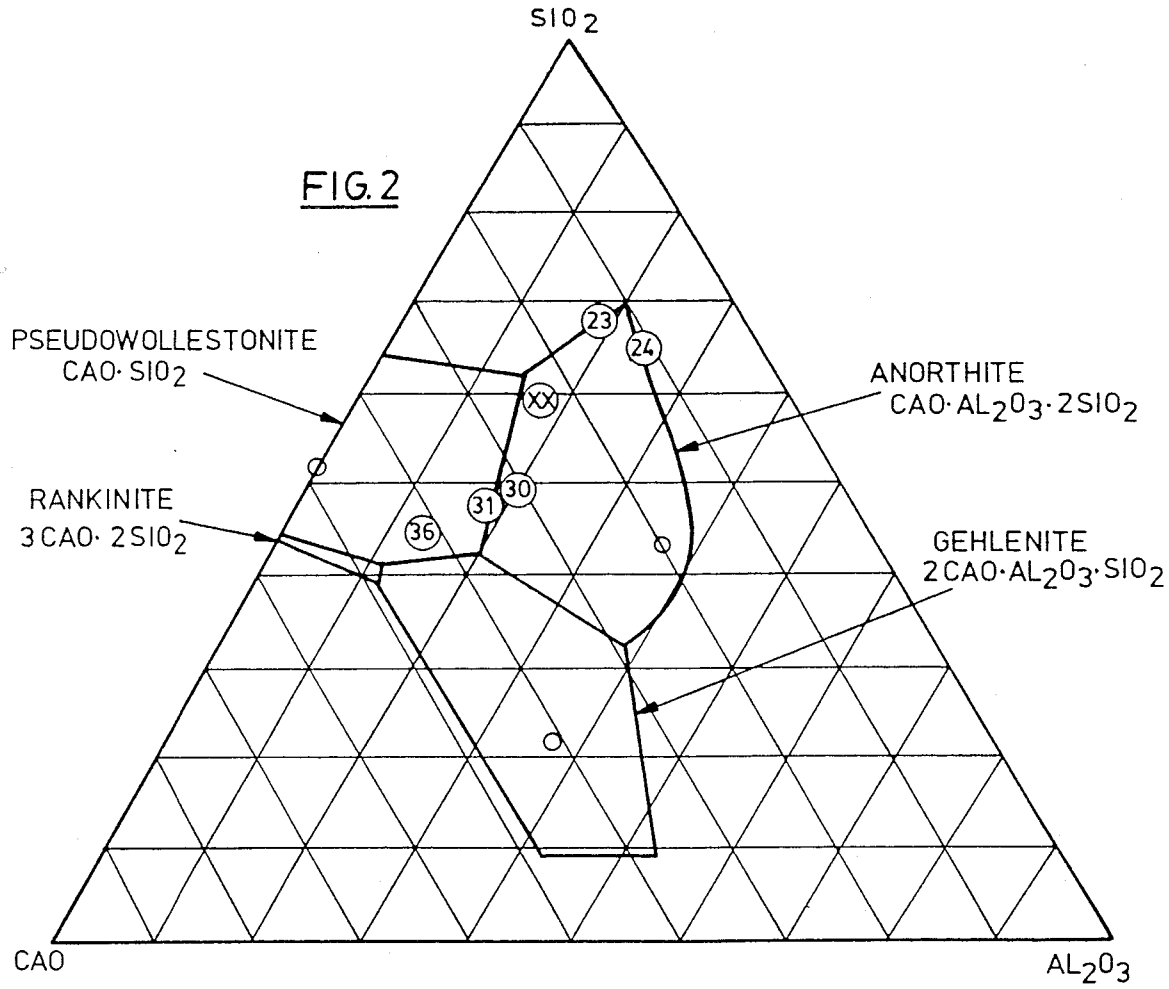
FIG. 2 is a ternary diagram of $CaO/Al_2O_3/SiO_2$ for subituminous coals as-fired in a low $NO_x/SO_x$ burner.

Of the complex, refractory compounds which might be formed of these coal ashes, FIG. 2 shows that the first version of the Whitewood coal and the Black Mesa coal might form predominantly anorthite but the rest would be expected to form major fractions of pseudowollestonite as well. Pseudowollestonite (CaO.SiO2) involves the expected 1:1 mole ratio of calcium to silicon but direct substitution of CaS for the CaO would indicate a 1:1 mole ratio of calcium to sulphur as well. The most likely sulphur-bearing refractory compound might involve two moles of pseudowollestonite, as CaO.CaS.2SiO2. In any case, the ashes of all of these coals are in the proper proportions to form a number of complex, refractory compounds involving calcium-silicon and aluminum.

EXAMPLE 5

Five blends of high sulphur eastern bituminous coals and binding/retaining additive were also fired in the low $NO_x/SO_x$ burner. Appropriate data for these coals and tests are shown in Table 3, for both the as-received and as-fired coals. The table shows the proportions of calcium, silicon and alumina, expressed as percent of these ash components. The proportions of calcium, silicon and aluminum are also shown in a ternary diagram in FIG. 3. In addition, Table 3 also shows data on predicted and actual sulphur capture and retention, with the predictions based on the assumptions that approximately a 2:1 mole ratio of calcium to sulphur and a 1:1 mole ratio of silicon to calcium are necessary for capture and retention. Listed under "Capture" in Table 3 are one-half the mole ratios of calcium to sulphur (Ca/2S). If a 2:1 calcium/sulphur mole ratio is required, then these Ca/2S ratios directly predict the percent of sulphur in the coal that will be captured in the burner first stage.

Listed under "Retention" are the mole ratios of silicon to calcium (Si/Ca). If a 1:1 silicon/calcium mole ratio is required to retain all of the captured sulphur, then these Si/Ca ratios directly predict retention of the captured sulphur. Retention data shown in the table represent, under normal operating conditions in each test, the highest percent retention of sulphur captured in the first stage of the burner through the high temperature, relatively more oxidizing second stage of the burner. In theory, no sulphur should be retained in the solids through this second stage. There were additional, smaller loss of captured sulphur further downstream, in the simulated boiler section for the low $NO_x/SO_x$ burner test facility, but those operating conditions are not considered appropriate for this example. Retention data were not available from test 32.

TABLE 3

High Sulphur Eastern Bituminous Coals (all data expressed in percent)

| Test No. | Coal | CaO | $SiO_2$ | $Al_2O_3$ | Capture Ca/2S | Capture Meas | Retention Si/Ca | Retention Meas |
|---|---|---|---|---|---|---|---|---|
| As Received | | | | | | | | |
| 32'/35' | Seminole | 3 | 72 | 25 | 1.6 | — | 2644 | — |
| 33' | Blacksville | 6 | 62 | 32 | 3.4 | — | 944 | — |
| 34' | Prince Mines | 2 | 62 | 36 | 1.3 | — | 2638 | — |
| 38' | Illinois #6 | 7 | 62 | 31 | 3.0 | — | 846 | — |
| As Fired | | | | | | | | |
| 32 | Seminole | 59 | 27 | 14 | 121 | 70 | 41 | — |
| 33 | Blacksville | 60 | 27 | 13 | 76 | 71 | 42 | 59 |
| 34 | Prince Mines | 41 | 41 | 19 | 77 | 68 | 93 | 71 |
| 35 | Seminole | 42 | 37 | 21 | 67 | 63 | 81 | 84 |
| 38 | Illinois #6 | 37 | 51 | 12 | 90 | 68 | 128 | 95 |

Figure 3:
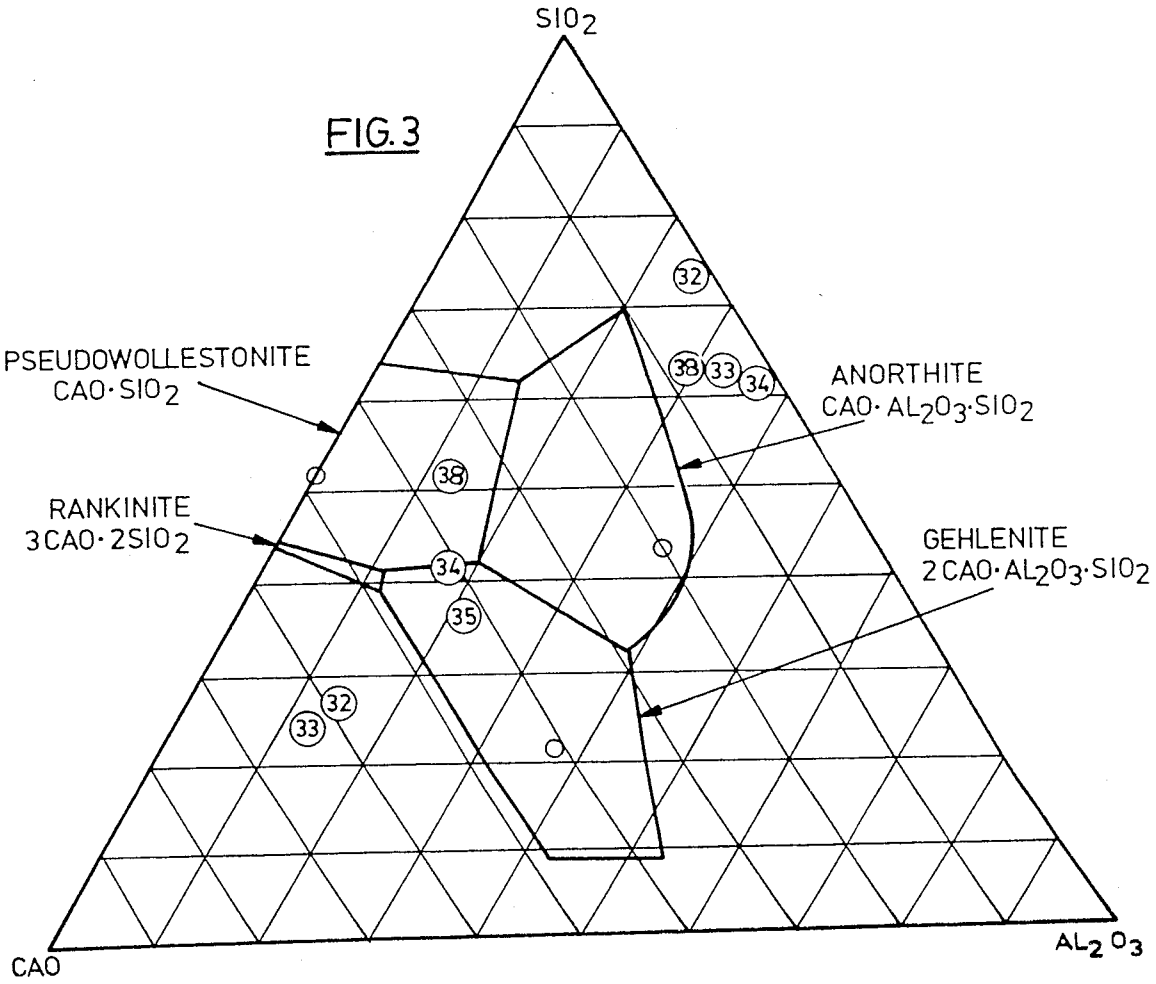
FIG. 3 is a ternary diagram of CaO/Al2O3/SiO2 for bituminous coals both as-received and as-fired in a low $NO_x/SO_x$ burner.

Typically, eastern bituminous coals tend to be more acidic, inherently containing almost no calcium but large fractions of silicon. FIG. 3 shows that there would be large excesses of silicon and aluminum and little formation of the complex calcium, silicon and aluminum compounds in the ashes of the as-received coals. For tests 32 and 33 large amounts of calcium (only) were added to the coal prior to test. FIG. 3 shows that the resulting mixtures were then on the opposite side of the ternary diagram, yielding large excesses of calcium and again little formation of the complex compounds of these materials. For tests 34, 35 and 38, however, both calcium and silicon were added. The resulting mixtures for these tests were then in the region of the ternary diagram indicating the potential for formation of the refractory compounds of calcium, silicon and aluminum.

Table 3 shows that there is almost no calcium in the as-received coals. Although these particular coals were not tested as-received in the low $NO_x/SO_x$ burner, it is well known that all but a few percent of the sulphur would be oxidized to SO2, regardless of how the coal was burned. Therefore, the large fractions of sulphur captured with the as-fired coals are clearly due to the addition of calcium. This calcium was simply loosely added, as limestone, to the as-received coal prior to pulverizing.

The actual amount of sulphur that can be captured in the low $NO_x/SO_x$ burner is first dependent on the combustion conditions in the burner first stage during the test, in accordance with the combustion process described above. However, according to this invention, this capture cannot exceed that which can be supported by the 2:1 mole ratio of calcium to sulphur. Table 3 shows that in the as-fired coal tests enough calcium had been added to support sulphur capture ranging from 67 to 100%, based on the criterion of one-half of the calcium/sulfur mole ratio. Measured sulphur capture ranged from 63 to 71%. In three of these tests measured sulfur capture on the average was lower than predicted by only 6%. In tests 32 and 38, however, it was lower by 22–30%. A conclusion here is that sulphur capture in tests 32 and 38 was limited by first stage combustion conditions while that in tests 33 through 35 was limited primarily by the lack of calcium.

Table 3 also shows that, based on the criterion of a 1:1 silicon/calcium mole ratio, only the coal tested in test 38 contained enough silicon to retain all of the sulphur, if all of the sulphur were captured. No sand was added to the coals fired in tests 32 and 33. Although the available data are limited and scattered, that data indicate that captured sulphur was poorly retained. Sand was added to the coals fired in tests 34, 35 and 38, however, providing Si/Ca mole ratios from 81 to better than 100%. Retention in these tests ranged from 71 to as high as 95%. The conclusion here is that the addition of sand significantly improved retention of captured sulphur, in approximate proportion to the Si/Ca mole ratio.

In general, with few exceptions, use of the 2:1 calcium/sulphur and the 1:1 silicon/calcium mole ratios is reasonably accurate to predict the upper limit of sulphur capture and the overall degree of control of SO2 emissions to atmosphere. In tests 33, 34 and 35 predicted maximum sulphur capture was only 6% higher than actually achieved, and in all cases predicted capture was higher than measured. Predicted retention of captured sulphur, based on the 1:1 silicon/calcium ratio, was also reasonably accurate, on the average in error by less than 2%. These results, in turn, dictate the proportions of binding and retaining material necessary to provide optimum control of $SO_2$ emissions. In general, the data in this example confirm that optimum capture and retention of coal sulphur results when the calcium/sulphur mole ratio is about 2.0 and the silicon/calcium ratio is about 1.0.

EXAMPLE 6

An Illinois No. 6 coal was tested in one of the low $NO_x/SO_x$ burners, again generally under operating conditions as described in the above incorporated Moriarty, et al., reference. This bituminous coal was tested both as received, containing almost no calcium, and with sufficient calcium added to provide a 2:1 mole ratio of calcium to sulphur. During this testing an isokinetic sampling probe was used to capture samples of the airborne flyash. These solids showed the chlorine related data shown in Table 4. While there is considerable scatter in the limited data in Table 4 it is clear that considerably more chlorine, by about a factor of almost five, was retained in the solid form when the calcium was present than when it was not. In these particular tests sulphur was retained in these same solids in similar proportion, averaging 20 percent in the as-received coal and 72 percent with calcium added.

TABLE 4

| Chlorine in Illinois No. 6 Flyash | | |
|---|---|---|
| Sample No. | Chlorine/Ash Ratio, % | Chlorine Retention, % |
| As-Received Testing | | |
| Coal | 0.664 | — |
| Sample 2 | .078 | 11.8 |
| Sample 4 | .051 | 7.7 |
| Sample 5 | .135 | 20.3 |
| Average | 0.088 | 13.2 |
| Calcium Added | | |
| Coal | 0.249 | — |
| Sample 2 | .120 | 48.3 |
| Sample 3 | .191 | 76.7 |
| Average | 0.156 | 62.7 |

EXAMPLE 7

One low sulphur western subituminous coal, Spring Creek, that was fired in the low $NO_x/SO_x$ burner contained relatively high concentrations, 7.75 percent, of sodium in the as-fired coal ash. After the test of this coal samples were obtained of the burner slag and of the baghouse flyash. These samples contained 3.12 and 6.39 percent sodium, respectively.

Using total ash as a tracer, the 3.12 percent slag analysis indicates that at least 40 percent of the sodium input with the coal was retained in the solids that ended up in the slag pit. This suggests that 60 percent may have volatilized. Volatilized sodium should recondense in the cooler regions of the (simulated) boiler downstream of the burner and, in particular, on the flyash heading for the baghouse. The 6.39 percent flyash analysis, however, represents 82 percent of the input sodium concentration, which does not suggest sodium enrichment by recondensation. Other data from this test were not sufficient to accurately close a sodium balance.

The available data suggest that between 40 and 82 percent of the sodium in the coal was retained in the solids. Even 40 percent retention is considerable, however, considering that those slags were exposed to combustion gas temperatures of as high as 1600 K. for many minutes, before dropping into the cooler regions of the slag pit. While this data is extremely limited, leaving a wide range of uncertainty regarding the fate of all of the sodium input to this burner with the coal, it seems clear that major fractions are retained in the solids in this burner.

I claim:

1. A process for combusting a sulphur-bearing fuel comprising the steps of:

(a) introducing a mixture of said fuel, sulphur binding material and sulphur retaining material into a first combustion zone;

(b) combusting said mixture in said first zone under conditions of fuel-rich stoichiometry and temperature wherein substantially all of said sulphur is captured in a solid form by said sulphur binding material and wherein the so-captured sulphur is bound to said sulphur retaining material, to produce combustion products including fuel-rich gases and solid sulphur-bearing flyash and slag;

(c) combusting said combustion products in at least one additional fuel-rich combustion zone at conditions normally thermodynamically unfavourable for sulphur capture by said sulphur binding material and at a temperature above the fusion temperature of said solid sulphur-bearing flyash and slag to induce further interaction between the sulphur, the binding material and the retaining material to retain said sulphur in a solid form.

2. The process of claim 1 wherein said sulphur binding material is a calcium compound.

3. The process of claim 2 wherein the overall mole ratio of calcium to sulphur in said mixture is at least 1.5:1.

4. The process of claim 2 wherein the overall mole ratio of calcium to sulphur is in the range of 1.5:1–2.5:1.

5. The process of claim 2 wherein the mole ratio of basic components to sulphur in the mixture is 2:1.

6. The process of claim 1 wherein said sulphur retaining material is selected from silicon compounds, and mixtures of silicon compounds and aluminum compounds.

7. The process of claim 6 wherein the mole ratio of silicon to calcium involved in the sulphur capture is in the range of 0.6 to 1.2.

8. The process of claim 6 wherein the mole ratio of silicon to calcium involved in the sulphur capture is in the range of 0.8 to 1.0.

9. The process of claim 1 wherein sodium is present in said mixture and said sodium is also captured and retained in a solid form in said first and second zones.

10. The process of claim 1 wherein at least part of said sulphur binding material is inherent in said fuel.

11. The process of claim 1 wherein at least part of said sulphur retaining material is inherent in said fuel.

12. The process of claim 5 wherein said basic components are magnesium and calcium.

13. The process of claim 10 wherein said fuel is coal.

14. The process of claim 11 wherein said fuel is coal.

* * * * *

UNITED STATES PATENT AND TRADEMARK OFFICE

CERTIFICATE OF CORRECTION

PATENT NO. : 4,807,542

DATED : February 28, 1989

INVENTOR(S) : Dykema

It is certified that error appears in the above-identified patent and that said Letters Patent is hereby corrected as shown below:

Figure 3, reference numerals "32", "33", "34", and "38" at the upper right should read --32'--, --33'--, --34'--, and --38'--.

Signed and Sealed this

Tenth Day of April, 1990

*Attest:*

HARRY F. MANBECK, JR.

*Attesting Officer*

*Commissioner of Patents and Trademarks*